US007053325B2

(12) United States Patent
Yuasa et al.

(10) Patent No.: US 7,053,325 B2
(45) Date of Patent: May 30, 2006

(54) ELECTRIC POWER TOOL

(75) Inventors: Yuichi Yuasa, Fuchu (JP); Yasuo Wada, Fuchu (JP); Shinji Morimune, Fuchu (JP)

(73) Assignee: Ryobi Ltd., Fuchu (JP)

( * ) Notice: Subject to any disclaimer, the term of this patent is extended or adjusted under 35 U.S.C. 154(b) by 0 days.

(21) Appl. No.: 11/036,352

(22) Filed: Jan. 18, 2005

(65) Prior Publication Data

US 2005/0174706 A1 Aug. 11, 2005

(30) Foreign Application Priority Data

Feb. 9, 2004 (JP) ..... 2004-032215

(51) Int. Cl.
*H01H 13/02* (2006.01)

(52) U.S. Cl. ..... 200/522

(58) Field of Classification Search ..... 200/1 V, 200/43.11, 43.17, 293, 43.18, 334, 500–574, 200/329–332.2, 61.85
See application file for complete search history.

(56) References Cited

U.S. PATENT DOCUMENTS

| | | | | |
|---|---|---|---|---|
| 2,711,461 | A * | 6/1955 | Happe | 200/522 |
| 3,383,943 | A * | 5/1968 | Piber | 74/529 |
| 3,413,498 | A * | 11/1968 | Bowen, III et al. | 310/47 |
| 3,671,699 | A * | 6/1972 | Matthews | 200/522 |
| 3,676,627 | A * | 7/1972 | Happe | 200/522 |
| 3,703,646 | A * | 11/1972 | Jacyno | 310/47 |
| 4,064,447 | A * | 12/1977 | Edgell et al. | 320/111 |
| 4,204,580 | A * | 5/1980 | Nalley | 173/48 |
| 4,847,451 | A * | 7/1989 | Nagata | 200/1 V |
| 5,401,928 | A * | 3/1995 | Kelley | 200/510 |
| 6,787,721 | B1 * | 9/2004 | Huang | 200/334 |
| 6,803,683 | B1 * | 10/2004 | Bone et al. | 310/50 |

FOREIGN PATENT DOCUMENTS

| | | |
|---|---|---|
| JP | U 1-63027 | 4/1989 |
| JP | U 6-61473 | 8/1994 |
| JP | 07-326249 | 12/1995 |
| JP | A 2002-154073 | 5/2002 |
| JP | A 2003-260675 | 9/2003 |

* cited by examiner

*Primary Examiner*—Elvin G. Enad
*Assistant Examiner*—Lisa Klaus
(74) *Attorney, Agent, or Firm*—Oliff & Berridge, PLC

(57) ABSTRACT

An electric power tool includes a housing, an electric power, a trigger, a trigger-limitation device and a switching device. The housing receives the electric power unit having an output shaft. The trigger is slidably mounted on the housing so as to control operation of the electric power unit. The trigger-limitation device is mounted on the housing so as to be movable between a limited position and an unlimited position. The trigger-limitation device comes into contact with the trigger to limit a stroke of the trigger, when being kept in the limited position, and not coming into contact with the trigger to impose no limitation to the stroke of the trigger, when being kept in the unlimited position. The switching device is provided on the housing in a different place from the trigger-limitation device. The switching device operates the trigger-limitation device to move between the limited position and the unlimited position.

7 Claims, 8 Drawing Sheets

ELECTRIC POWER TOOL

BACKGROUND OF THE INVENTION

1. Field of the Invention

The present invention relates to an electric power tool having an output control structure.

2. Related Art

An electric power tool such as an impact driver has a switching structure, which enables the tool to be operated in the alternative of two modes in output in accordance with material to be worked and a finishing operation applied thereto, in order to prevent a head of a screw to be wrenched away from it shank or a screw to be turned excessively tightly, as shown in Japanese Patent Provisional Publication No. H7-326249.

More specifically, such a kind of electric power tool has a trigger, which is connected to a switch box so that output increases in proportion to an amount of pulling operation of the trigger, and a dial type-adjustment knob is normally placed between the trigger and the switch box so that turning the knob between two positions enables the tool to be operated in the alternative of two modes in the maximum amount of pulling operation of the trigger to provide a controlled output. Turning the knob to one of the two modes, i.e., the low output mode enables the output to be increased to the maximum in the low output mode in proportion to an amount of pulling operation of the trigger. Turning the knob to another mode, i.e., the high output mode enables the trigger to be further pulled to increase the output to the maximum in the high output mode in proportion to an amount of pulling operation of the trigger.

There has been another type of electric power tool provided with output terminals extended from a switch box. In such a tool, a signal for switching the rotation mode is detected by an independent switch to make a change in output voltage and number of revolutions. The switching operation of the above-mentioned independent switch between high and low modes makes it possible to make a change in degree of variation of output in accordance with an amount of pulling operation of the trigger.

However, in the former conventional power tool, when the trigger is pulled, an operator's finger may come into contact with the knob, thus compelling an operator to work under a load, especially in case where a long period of working time is required. Fingers may come into contact with the knob to turn it inadvertently, resulting in occurrence of a problem of change in number of revolutions of an output shaft. In addition, in the former conventional power tool in which the amount of pulling operation of the trigger is switched by the knob, variations in an amount of pulling operation of the trigger occur due to variation in thickness of the knob and variation in clearance between the knob and the housing. As a result, when output characteristics are provided based on a proportional curve, errors in output voltage increase in accordance with variation in the amount of pulling operation of the trigger. Accordingly, a problem may occur that, when the low output is actually required, a screw is turned on a high output power.

In the latter conventional power tool, modification of a circuit in the general-purpose switch box is required, thus resulting in increased costs of parts. In addition, the switch for detecting the signal must be provided independently, thus increasing the number of parts and leading to complicated handling of lead wires. Accordingly, the assembling property is deteriorated.

SUMMARY OF THE INVENTION

An object of the present invention is therefore to provide an electric power tool, which can solve the above-mentioned problems and inconvenience.

In order to attain the aforementioned object, the electric power tool according to one of aspects of the present invention comprises: a housing; an electric power unit received in the housing, the electric power unit having an output shaft; a trigger slidably mounted on the housing, the trigger controlling operation of the electric power unit; a trigger-limitation device mounted on the housing so as to be movable between a limited position and an unlimited position, the trigger-limitation device coming into contact with the trigger to limit a stroke of the trigger, when being kept in the limited position, and not coming into contact with the trigger to impose no limitation to the stroke of the trigger, when being kept in the unlimited position; and a switching device provided on the housing in a different place from the trigger-limitation device, the switching device operating the trigger-limitation device to move between the limited position and the unlimited position.

According to the present invention, the trigger-limitation device determines the maximum stroke of the trigger to control the operation of the electric power unit, and the switching device, which is provided in a different place from the trigger-limitation device, operates the trigger-limitation device to move between the limited position and the unlimited position. As a result, an operator's fingers do not come into contact with the trigger-limitation device, when pulling the trigger. It is therefore possible to prevent the operator from working under a load, especially in case where a long period of working time is required, and avoid uncomfortable feeling of the operator. There is no possibility that the trigger-limitation device may be switched into the different mode, resulting in change in number of revolutions of the output shaft. Major modification made to the switch box is not required, so that general-purpose switch boxes can be utilized, thus providing advantageous effects.

In the other aspect of the present invention, the electric power tool may further comprises a flexible power transmission member through which the trigger-limitation device and the switching device are connected; and the housing may be composed of a pair of half portions having abutting edges, which are to be brought into contact with each other, the abutting edges defining a guide passage in which the flexible power transmission member is to be received.

According to the present invention, the trigger-limitation device and the switching device are connected through the flexible power transmission member, which is received in the guide passage formed on the abutting edges of the half portions of the housing. Consequently, the flexible power transmission member can be elastically deformed into any shape so as to enable the trigger-limitation device to be placed in any posture in a desired position. Receiving the flexible power transmission member in the guide passage formed on the abutting edges of the half portions of the housing makes it unnecessary to provide a specific space for receiving the power transmission member, thus avoiding a complicated structure of the housing.

In the other aspect of the present invention, the trigger-limitation device that is kept in the limited position may enable the trigger to be slid within a low torque range in the stroke thereof, the low torque range being provided at an upper section thereof with a constant torque zone.

According to the present invention, the low torque range is provided at an upper section thereof with the constant torque zone. As a result, even if there are variations in an amount of pulling operation of the trigger due to manufacturing error in a state that the trigger-limitation device is kept in the limited position, the output based on the stroke of the trigger is kept within the constant torque zone, which is provided in the upper section of the low torque range, thus preventing occurrence of variations in output properties in the low torque range and providing a stable low torque.

In the other aspect of the present invention, the switching device may be a lever, the flexible power transmission member may be formed of a substantially non-extensible material and the flexible power transmission member may be a wire.

According to the present invention, it is possible to make the general structure of the electric power tool simple, thus reducing the production costs.

DESCRIPTION OF THE PREFERRED EMBODIMENTS

Figure 1:
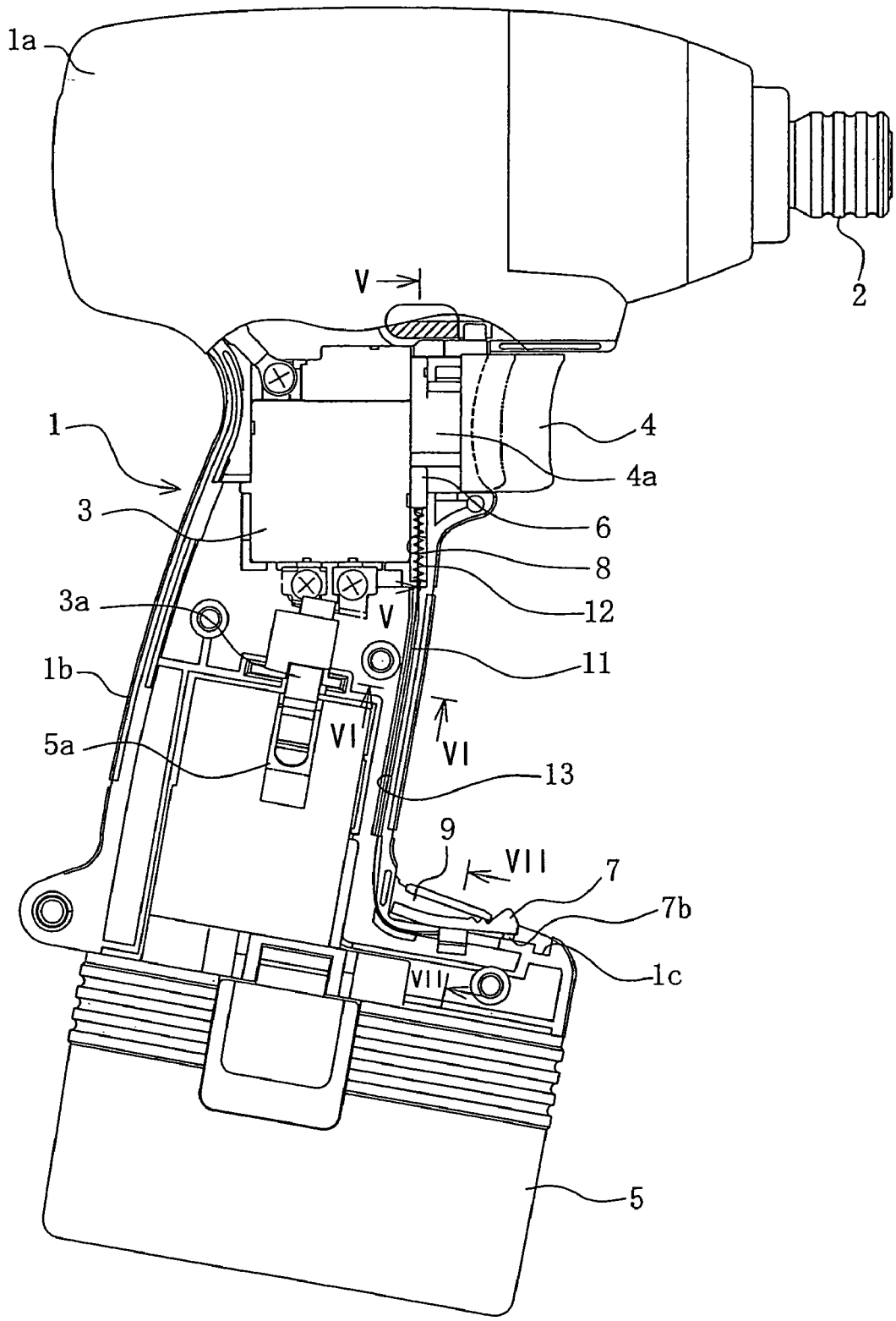
FIG. 1 is a front view of an electric power tool according to the embodiment of the present invention, with a part of one of a pair of half portions of a housing broken, illustrating a state that a trigger-limitation device is kept in a limited position to provide a low torque mode and a motor of an electric power unit is in an "OFF" position.

Now, embodiments of an electric power tool of the present invention will be described in detail below with reference to the accompanying drawings.

As shown in FIGS. 1 to 4, the electric power tool of the present invention is constructed as an impact driver. The impact driver has a fundamental structure including a housing 1, an electric power unit (not shown), a trigger 4, a trigger-limitation device 6 and a switching device 7.

More specifically, the impact driver has a housing 1, which is composed of a pair of half portions. The half portions of the housing 1 have abutting edges, respectively, which are to be brought into contact with each other on a plane that is in parallel with a drawing sheet. Such half portions are assembled into the housing 1 so that the abutting edges come into contact with each other on the above-mentioned plane. The half portions of the housing 1 are provided on their abutting edges at the front side of the housing 1 with grooves. Assembling the half portions into the housing 1 causes these grooves to be combined together to form a guide section 8 for a flexible power transmission member 11 as described later.

The housing 1 is provided at its upper portion 1*a* with a power unit chamber in which an electric power unit (not shown) including a motor, a speed reducer, hammers and the other components is received. The electric power unit has an output shaft 2, which outward projects from the front end of the housing 1 at the upper side 1*a*.

The housing 1 has a lower portion 1*b*, which serves as a handle to be gripped by an operator. A switch box 3 is placed on the upper side in the lower portion 1*b* of the housing 1. The switch box is electrically connected to the motor of the above-described power unit.

In addition, the housing 1 has a receiving hole 4*a* on the upper and front side of the handle 1*b*. The trigger 4 is disposed on the upper and front side of the handle 1*b* so as to be slidable forward or backward (i.e., in the left-hand or right-hand direction in FIG. 1) in the above-mentioned receiving hole 4*a*. The sliding motion of the trigger 4 causes the associated switches in the switch box 3 to operate. An output of the motor increases according as a pulling amount of the trigger increases, so as to increase torque of the output shaft 2, as described later in detail.

A battery 5 is detachably connected to the lower end of the handle 1*b* so that terminals 5*a* of the battery 5 come into contact with terminals 3*a* of the switch box 3. In such a state, electric power is supplied from the battery 5 to the motor through the switch box 3.

The trigger-limitation device 6 and the switching device 7 control the stroke of the trigger 4 to enable the impact driver to operate in the alternative of a low torque mode (a variable number of rotations mode) and a high torque mode (a maximum number of rotations mode).

The trigger-limitation device 6 is placed between the switch box 3 and the trigger 4 and serves as a movable stopper, which is placed below the receiving hole 4*a* for the trigger 4 so as to be capable of projecting into the receiving hole 4*a* to provide a limited position or retracting therefrom to provide an unlimited position. When the trigger-limitation device 6 is kept in the limited position, it comes into contact with the trigger 4 to limit the stroke of the trigger. On the other hand, when the trigger-limitation device 6 is kept in the unlimited position, it does not come into contact with the trigger 4 to impose no limitation to the stroke of the trigger 4. The switching device 7, which is constituted in the form of a lever for controlling the trigger-limitation device 6, is placed on the housing 1 in a different place from the trigger-limitation device so as to be away therefrom.

More specifically, as shown in FIGS. 1, 5, 8 and 9, the trigger-limitation device 6 is a block having a rectangular parallelepiped with predetermined dimensions, which is formed as the above-mentioned movable stopper, and is slidably received in the upper side of the guide section 8, which extends upwardly between the front surface of the switch box 3 and the inner wall of the housing 1. The trigger-limitation device 6 can slide upward or downward in the guide section 8 between the switch box 3 and the trigger to project into the receiving hole 4*a* for the trigger 4 to provide the limited position or retract therefrom to provide the unlimited position, as mentioned above.

The lever 7 serving as the switching device is slidably placed on the lower and front end of the lower portion 1*b*, i.e., the handle of the housing 1. According to such a positional relationship between the trigger-limitation device 6 and the switching lever 7, an operator's fingers do not come into contact with the switching lever 7, when pulling the trigger. It is therefore possible to prevent a heavy load from being applied to the operator's fingers, especially in case where a long period of working time is required, and avoid uncomfortable feeling of the operator. There is no possibility that the trigger-limitation device 6 may be switched into the different mode, resulting in change in number of revolutions and torque of the output shaft 2. The position of the switching lever 7 is not limited only to the lower and front end of the handle of the housing 1. The switching lever 7 may be placed in the other desired position so as not to be brought into contact with an operator's finger by which the trigger is pulled.

Figure 7:
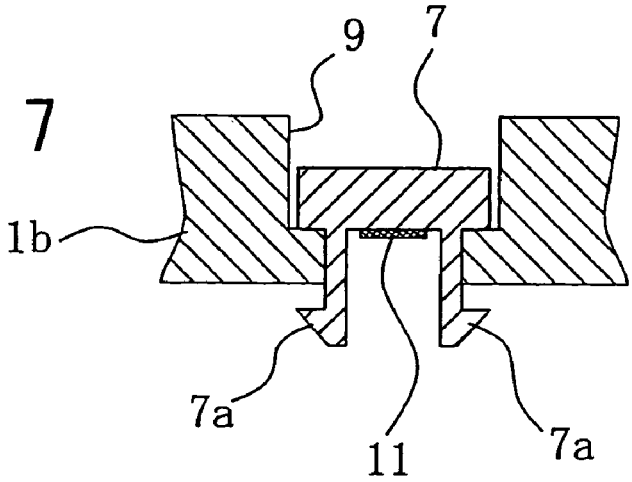
FIG. 7 is a sectional view cut along the line VII—VII line as shown in FIG. 1.
Figure 8:
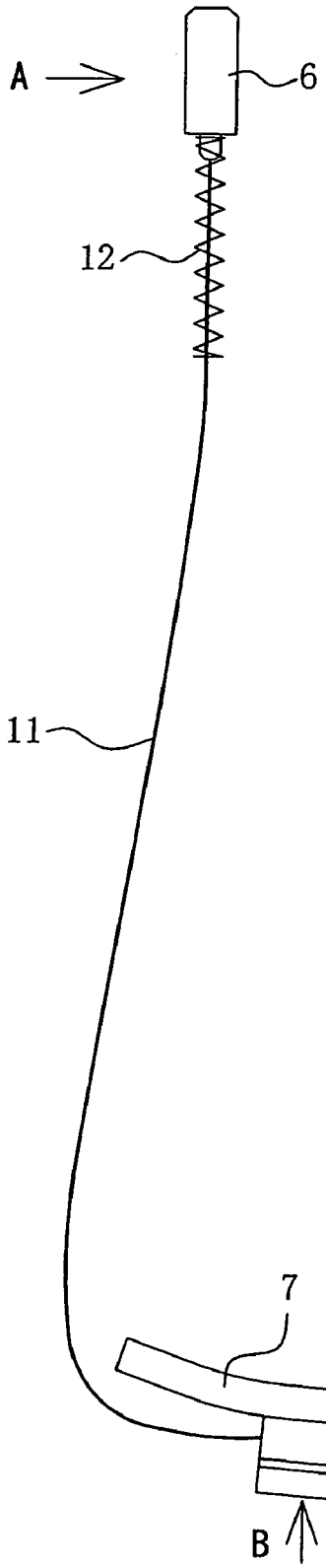
FIG. 8 is a front view illustrating the trigger-limitation device and a switching device, which are connected through a flexible power transmission member.
Figure 9:
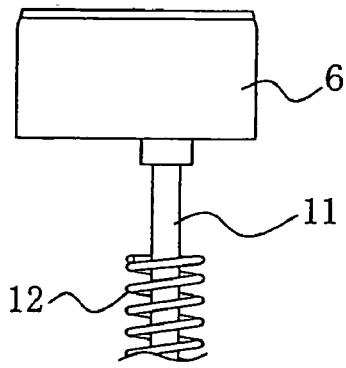
FIG. 9 is a side view illustrating the trigger-limitation device, viewed in a direction "A" as shown in FIG. 8.
Figure 10:
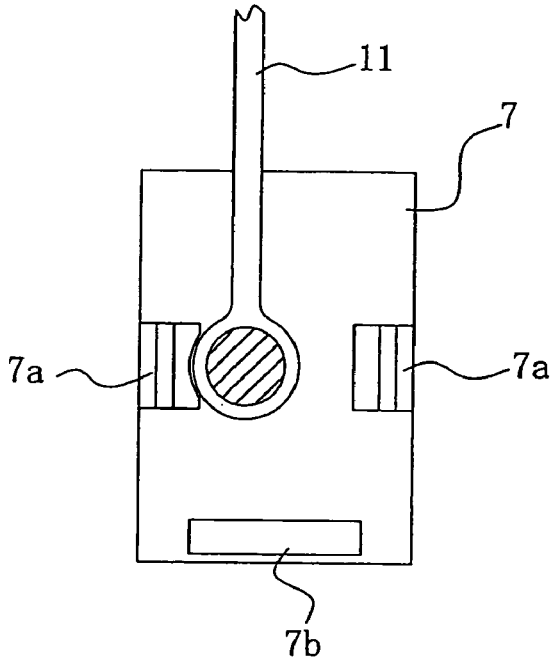
FIG. 10 is a bottom view illustrating the switching device, viewed in a direction "B" as shown in FIG. 8.

More specifically, as shown in FIGS. 7, 8 and 10, the switching lever 7 is a plate generally having a rectangular parallelepiped with predetermined dimensions, is placed on a portion, which extends forward from the lower end of the handle. Such an extended portion of the handle has a slit 9 formed therein so as to extend forward. The switching lever 7 is slidably inserted into the slit 9. The switching lever 7 has a pair of engaging legs 7*a*, which extend downward from the opposite side edges of the main body of the switching lever 7. The engaging legs 7 engage with side edges of the slit 9. Accordingly, the switching lever 7 can slide forward or backward in the slit 9, without coming off the slit 9.

The switching lever 7 has a projection 7*b* formed at the front end on the lower surface of the switching lever 7. On the other hand, the extended portion of the handle has a recess 1*c* formed on the front end of the extended portion so that the projection 7*b* of the switching lever 7 can engage with the recess 1*c*. The projection 7*b* of the switching lever 7 and the recess 1*c* of the handle constitute a switching lever-locking mechanism. When the switching lever 7 slides forward to reach a predetermined position, the projection 7*b* engages with the recess 1*c* to keep the switching lever 7 in a locking state. The engaging legs 7*a* of the switching lever 7 slidably engage with the side edges of the slit 9 so that the switching lever 7 can be inclined slightly as shown in FIGS. 1 and 7. Pushing down the rear end of the switching lever 7, which is kept in the locking state, causes the front end of the switching lever 7 to be slightly lifted up, with the result that engagement of the projection 7*b* with the recess 1*c* is released, thus releasing the locking state.

As shown in FIGS. 7 and 8, the trigger-limitation device 6 and the switching lever 7 are connected to each other by means of the flexible power transmission member 11. The flexible power transmission member 11 is formed of a thin elongated non-extensible strip. One end of the flexible power transmission member 11 is connected to the trigger-limitation device 6, and the other end thereof is connected to the switching lever 7. The other material such as wire or coil than the above-mentioned strip may be used as the flexible power transmission member 11. A compression spring 12 is placed between the trigger-limitation device 6 and the inner wall of the housing 1 so that the flexible power transmission member 11 is inserted into the compression spring 12. The flexible power transmission member 11, through which the trigger-limitation device 6 and the switching lever 7 are connected to each other, can be elastically deformed into any shape so as to enable the trigger-limitation device 6 to be placed in any posture in a desired position.

Figure 2:
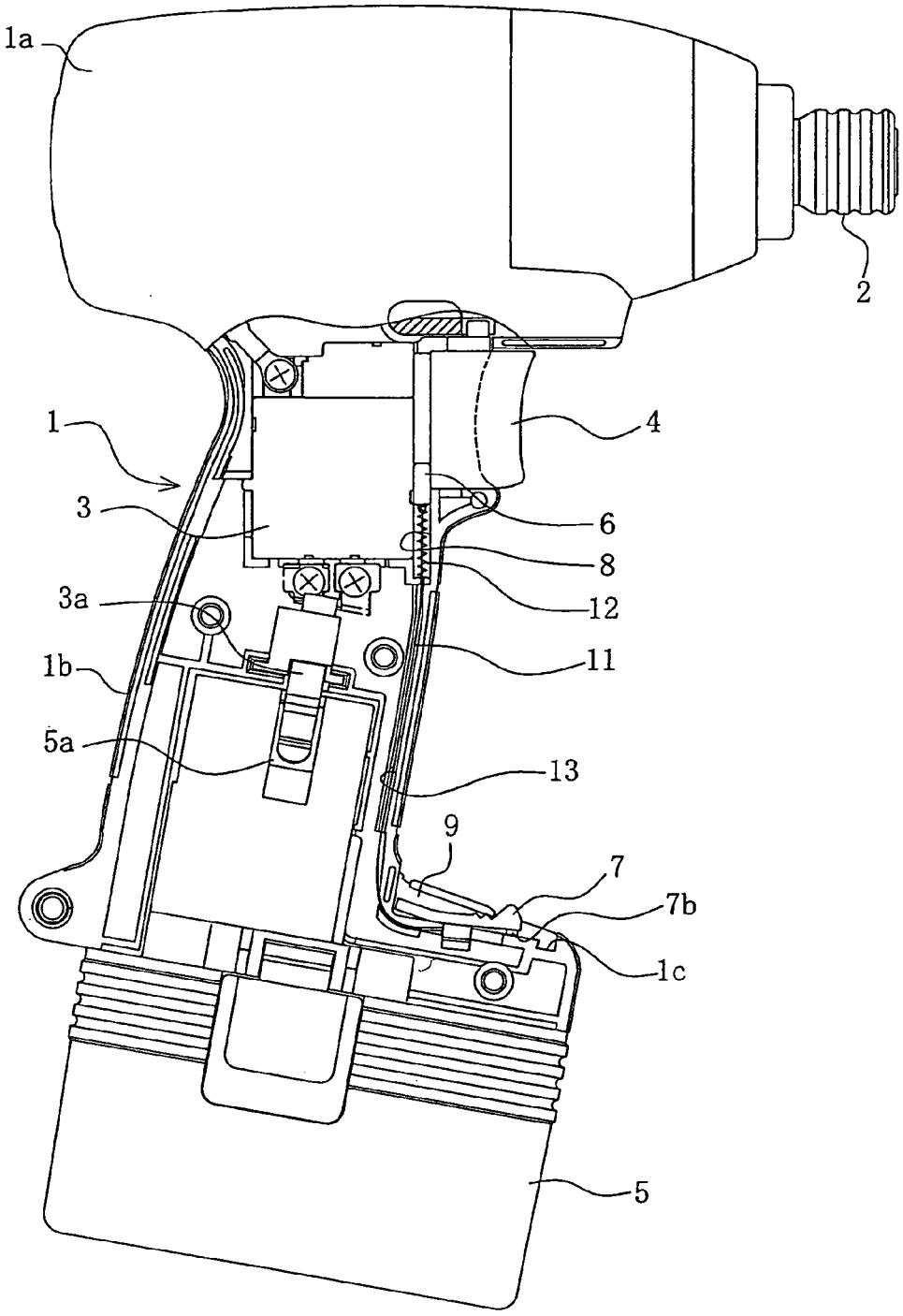
FIG. 2 is a front view of the electric power tool according to the embodiment of the present invention, illustrating a state that the trigger-limitation device is kept in the limited position to provide the low torque mode and the motor is in an "ON" position.
Figure 12:
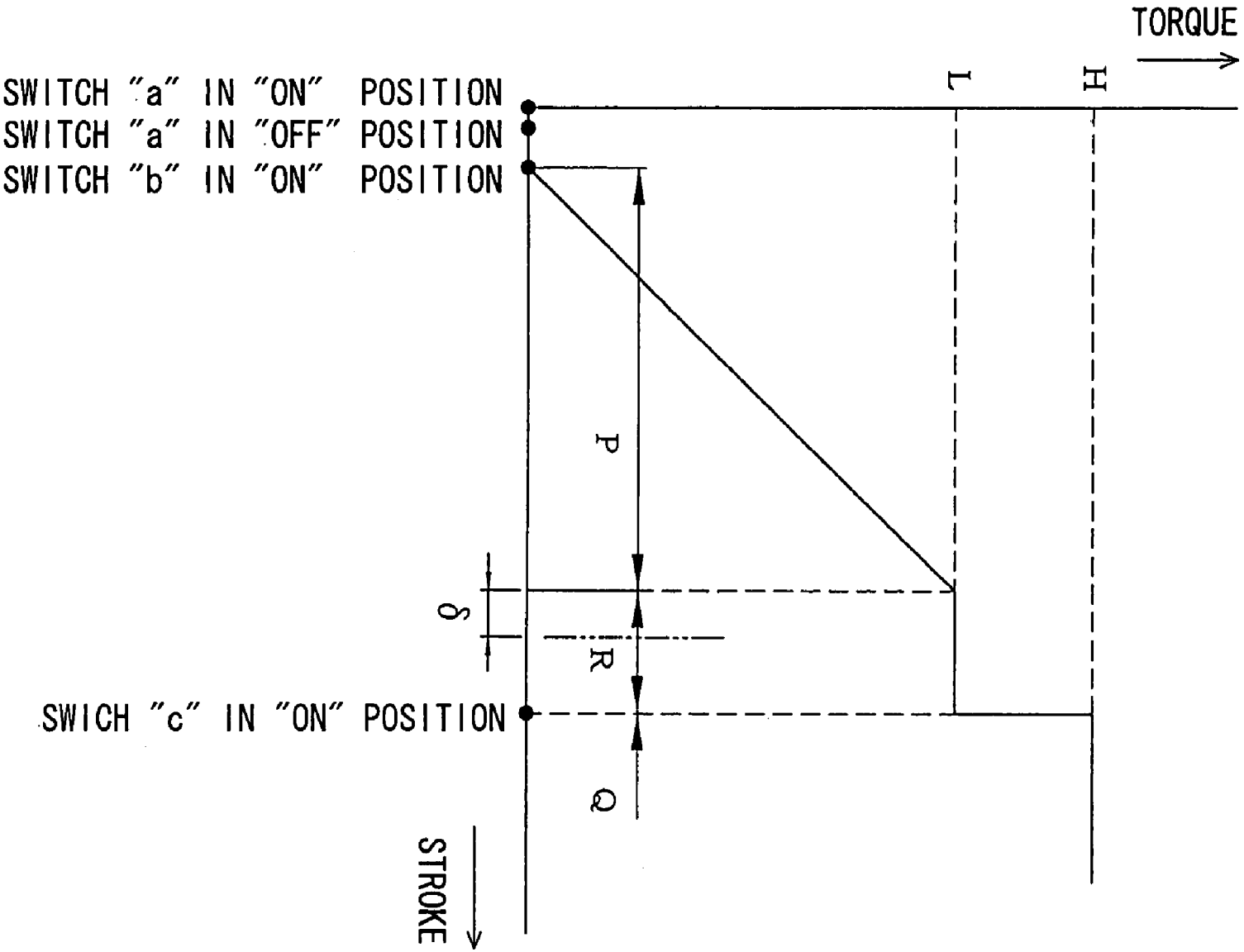
FIG. 12 is a graph showing control characteristics based on the control unit.

When the engagement of the projection 7*b* of the switching lever 7 with the recess 1*c* of the housing 1 is released as shown in FIG. 1, the resilient force of the compression coil spring 12 causes the trigger-limitation device 6 to slide upward in the guide section 8, with the result that the trigger-limitation device 6 projects in the receiving hole 4*a* for the trigger 4 between the front surface of the switch box 3 and the rear surface of the trigger 4. The resilient force of the compression coil spring 12 also causes the switching lever 7, which is connected to the trigger-limitation device 6 by means of the flexile power transmission member 11, to slide rearward along the slit 9 to be kept in a predetermined position. In such a state, the trigger 4 can move only until it comes into contact with the trigger-limitation device 6, in the full stroke of the trigger 4, as shown in FIG. 2. The output can therefore be increased or decreased in the low torque range "P" as shown in FIG. 12. As shown in FIG. 12, the low torque range "P" is provided at an upper section thereof with a constant torque zone "R". As a result, even if there are variations in an amount of pulling operation of the trigger 4 due to manufacturing error of the housing 1 and the trigger 4, the torque as outputted increases to the torque "L", but does not increase to a larger torque "H" (the maximum output), which is larger than the torque "L". It is therefore possible to fasten a screw with an appropriate torque.

Figure 3:
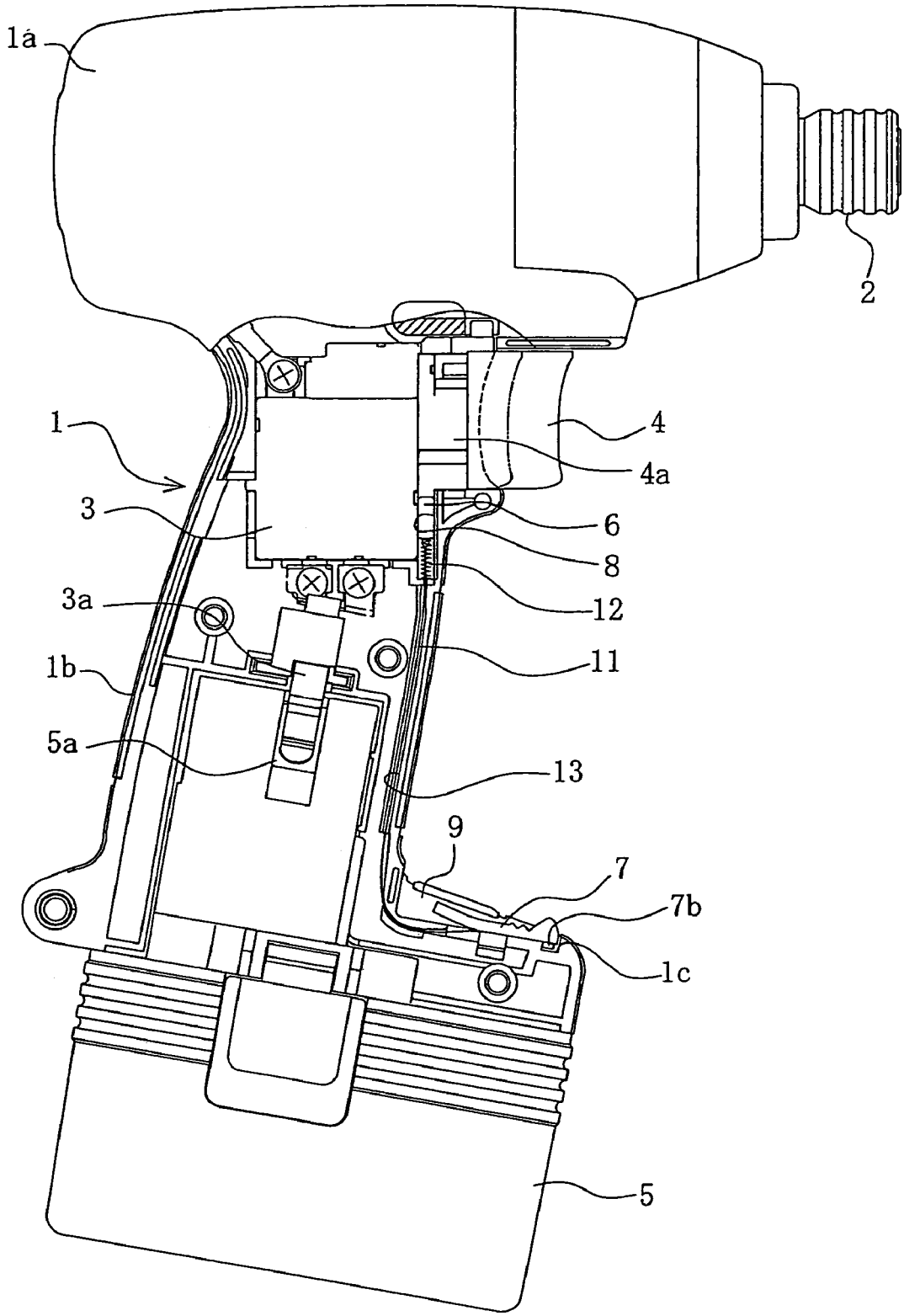
FIG. 3 is a front view of the electric power tool according to the embodiment of the present invention, illustrating a state that the trigger-limitation device is kept in the unlimited position to provide the high torque mode and the motor is in the "OFF" position.
Figure 4:
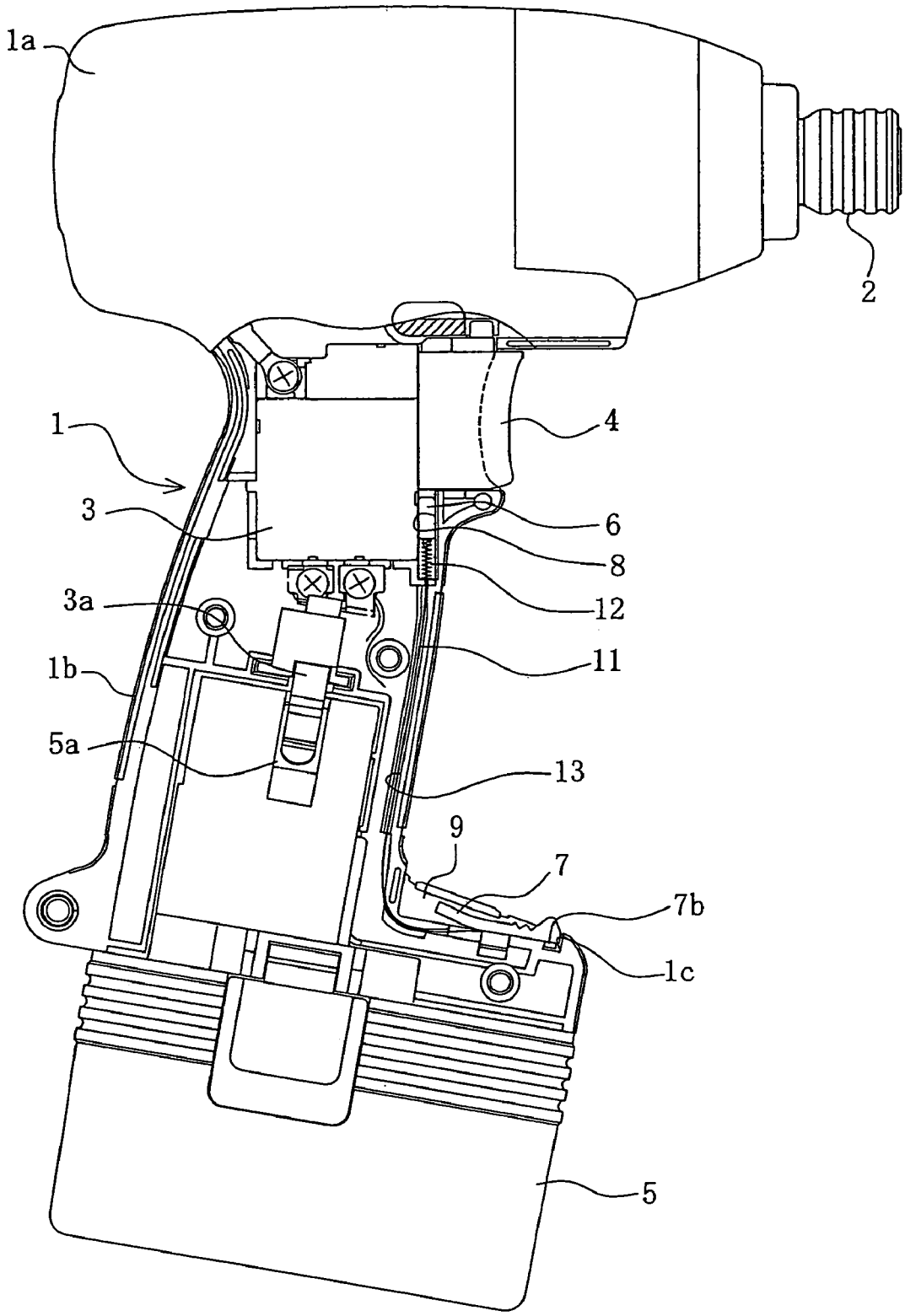
FIG. 4 is a front view of the electric power tool according to the embodiment of the present invention, illustrating a state that the trigger-limitation device is kept in the unlimited position to provide the high torque mode and the motor is in the "ON" position.
Figure 5:
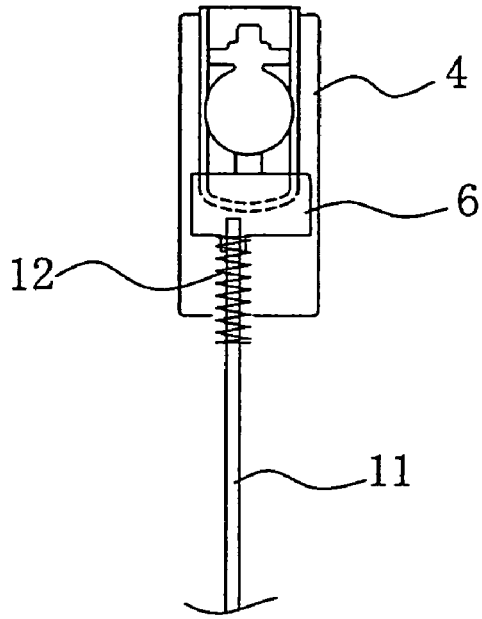
FIG. 5 is a view illustrating a relationship between a trigger and the trigger-limitation device, which is viewed along the line V—V as shown in FIG. 1.

On the other hand, when an operation is made to slide the switching lever 7 forward from the position as shown in FIG. 1 or 2 to the position as shown in FIG. 3 or 4, it is possible to operate the impact driver not only in the low torque range "P", but also in the high torque range "Q" as shown in FIG. 12. Such an operation of the switching lever 7 causes the trigger-limitation device 6, which is connected to the switching lever 7 by means of the flexible power transmission member 11, to slide down in the guide section 8 against the function of the compression coil spring 12 so as to retract from the receiving hole 4*a* for the trigger 3 between the switch box 3 and the trigger 4. When the switching lever 7 slides forward to reach a predetermined position, the projection 7*b* engages with the recess 1*c* to keep the switching lever 7 in the locking state. In such a state, the trigger 4 can move over its full stroke until it comets into contact with the switch box 3, as shown in FIG. 4. The output can therefore be increased or decreased in the high torque range "Q". When the trigger 4 is pulled in the high torque range "Q" to come into contact with the switch box 3, the maximum torque "H" is outputted, thus enabling a screw to be inserted into a hard material.

Figure 6:
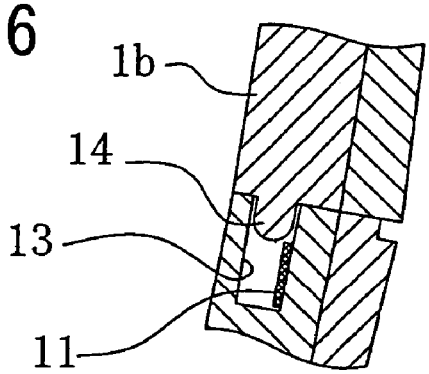
FIG. 6 is a sectional view cut along the line VI—VI line as shown in FIG. 1.

As shown in FIGS. 1 and 6, the flexible power transmission member 11 is received in a groove 13, which is defined by the abutting edges of the half portions of the housing 1. More specifically, one of the half portions is provided on its abutting edge with an elongated projection or projections 14 formed along the periphery of the abutting edge, and on the other hand, the other of the half portions is provided on its abutting edge with the groove 13 formed along the periphery of the abutting edge so that the elongated projection or projections 14 is fitted into the groove 13. The above-mentioned groove 13 has, on the front side in the handle, a portion having a larger depth than the other portion. The above-mentioned flexible power transmission member 11 is received in such a deeper portion of the groove 13 so as to be slidable in it. The sliding operation of the switching lever 7 causes the flexible power transmission member 11 to slide in the deeper portion of the groove 13 so that the trigger-limitation device 6 projects into the receiving hole 4*a* for the trigger 4 or retracts therefrom.

Figure 11:
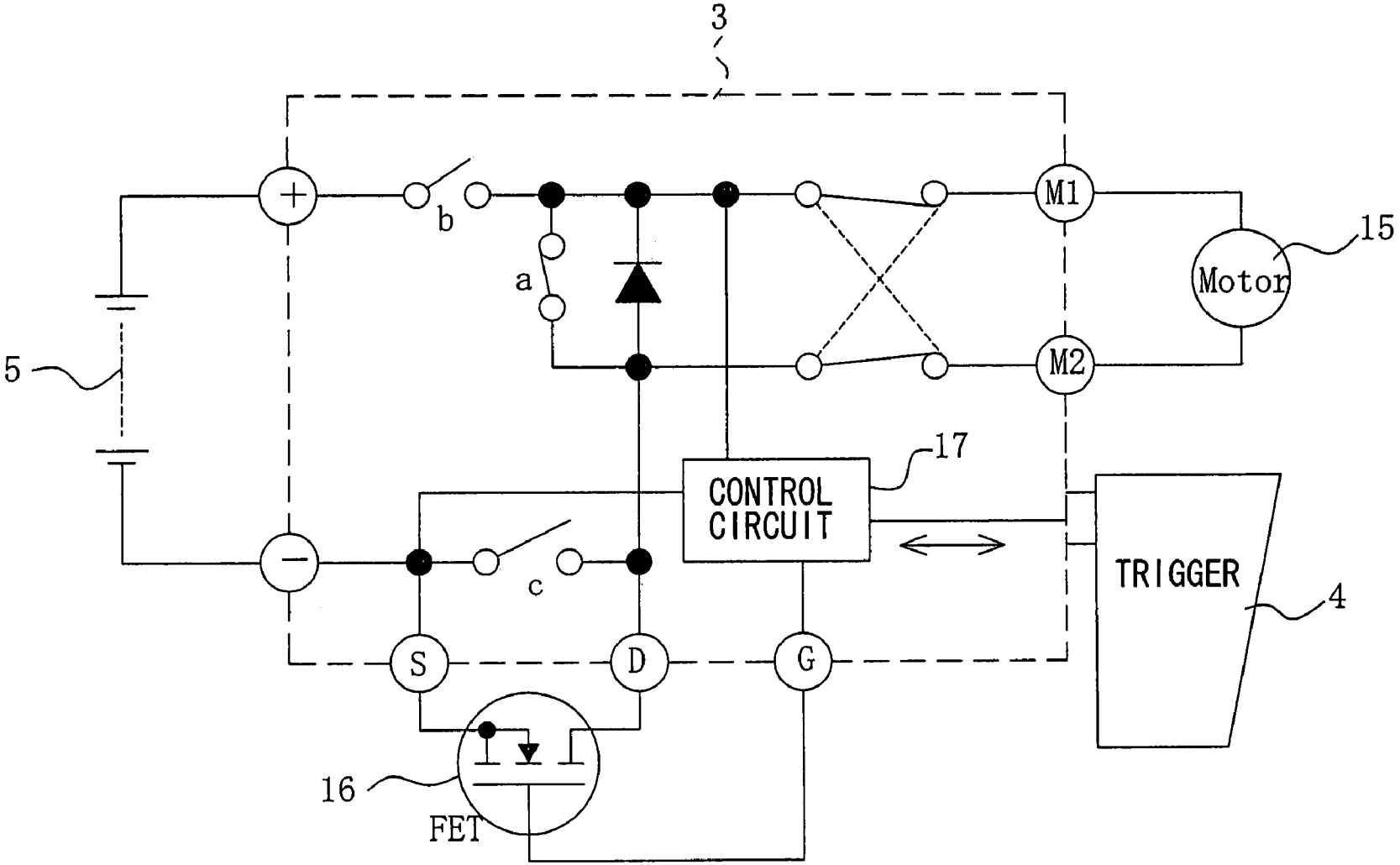
FIG. 11 is a circuit diagram of a control unit applied to the electric power tool according to the embodiment of the present invention.

Operation of the motor 15 of the electric power unit of the impact driver is controlled by means of a control unit, as shown in FIG. 11.

The control unit is received in a predetermined position in the switch box 3, which is independent from the battery 5, the motor 15, an FET (field-effect transistor) 16 and the trigger 4. The FET is placed for example in a position, which is subjected to an effective cooling, in the handle.

The switch box 3 has the same configuration as the circuit of the conventional general-purpose switch box, except for the control circuit 17. Accordingly, the conventional general-purpose switch box, which has been modified in the control circuit 17, may be used as the switch box 3.

The control circuit 17 is configured in the form of a CPU (central processing unit) so that internal resistance varies in accordance with a pulling amount of the trigger 4 in stroke. In addition, the control circuit 17 is also configured so that the low torque range "P" in the stroke of the trigger 4 is provided at the upper section thereof with a constant torque zone "R" in a length corresponding to the predetermined stroke, and the constant torque "L" can be ensured in the constant torque zone "R", as shown in FIG. 12. The length of the constant torque zone "R" is determined so as to be slightly larger than the distance of unfavorable movement of the trigger 4, which is caused by the maximum value of variations due to tolerances of parts such as the housing 1, the switch box 3, the trigger 4 and the trigger-limitation device 6. In case where the variation "δ" exists, the trigger 4 can move to the position of (P+δ) at the maximum, as shown in FIG. 12. According to such a control circuit 17, in case where the trigger-limitation device 6 is kept in the limited position so as to project in the receiving hole 4*a* for the trigger 4, as shown in FIGS. 1 and 2, even when existence of the variation "δ" makes the stroke of the trigger 4 larger than the predetermined stroke (i.e., a pulling amount) of the trigger 4, the constant torque zone "R" absorbs the variation "δ" to prevent the output voltage from being increased unnecessarily. As a result, it is possible to prevent the output torque from being increased so as to exceed the constant torque "L", thus permitting an operation of fastening a screw with an appropriate torque.

The configuration and operation of the control unit will be described below with reference to FIGS. 11 and 12. The switch "a" is kept in the "ON" position prior to the pulling operation of the trigger 4. When the trigger 4 is pulled in a small pulling amount, the switch "a" turns "OFF" and the switch "b" turns "ON". This operation provides continuity between the battery 5 and the motor 15 to cause the motor 15 to start. When the trigger 4 is pulled further, internal resistance of the control circuit 17 varies in accordance with a pulling amount of the trigger 4 so that torque of the motor 15 gradually increases toward the torque "L" in the low torque range "P" under the function of the FET 16, as shown in FIG. 12. In case where the trigger-limitation device 6 projects into the receiving hole 4*a* for the trigger 4 to provide the limited position, as shown in FIGS. 1 and 2, which enables the trigger 4 to slide only in the limited range, i.e., the low torque range "P", the constant torque zone "R" absorbs the movement of the trigger 4 in a slight amount caused by variations due to tolerances of parts such as the housing 1, the switch box 3, the trigger 4 and the trigger-limitation device 6, after the torque as outputted caused by pulling the trigger 4 reaches the maximum torque in the low torque range "P". As a result, the output torque does not exceed the torque "L".

On the other hand, in case where the trigger-limitation device 6 retracts from the receiving hole 4*a* for the trigger 4 to provide the unlimited position, as shown in FIGS. 3 and 4, the trigger 4 is permitted to slide in the full range in stroke. When the output torque reaches the torque "L" and then the trigger 4 is continuously pulled, the trigger 4 passes through the constant torque zone "R" and then enter the high torque range "Q" so that the switch "c" turns "ON". As a result, the output shaft 2 can provide the high torque "H" (the maximum torque).

Now, operation of the impact driver having the above-described structure will be described below.

When the engagement of the projection 7*b* of the switching lever 7 with the recess 1*c* of the housing 1 is released as shown in FIG. 1, the resilient force of the compression coil spring 12 causes the trigger-limitation device 6 to slide upward in the guide section 8, with the result that the trigger-limitation device 6 projects in the receiving hole 4*a* for the trigger 4 between the front surface of the switch box 3 and the rear surface of the trigger 4. The resilient force of the compression coil spring 12 also causes the switching lever 7, which is connected to the trigger-limitation device 6 by means of the flexile power transmission member 11, to slide rearward along the slit 9 to be kept in a predetermined position.

In such a state, when the trigger 4 is pulled as shown in FIG. 2, the motor 15 operates to rotate the output shaft 2. When the trigger 4 is pulled further, the torque increases in proportion to the stroke of the trigger 4, as shown in FIG. 12. Pulling the trigger 4 to the maximum in the low torque range "P", namely until the trigger 4 comes into contact with the trigger-limitation device 6 causes the torque "L" to be outputted from the output shaft 2.

After the output torque reaches the torque "L", the constant torque zone "R" absorbs a possible further movement of the trigger 4 caused by the variation "δ". As a result, the output torque "L" is maintained and further increase in torque is prevented, thus permitting an operation of fastening a screw with an appropriate torque.

When the larger output torque than the torque "L" is required, the switching lever 7 is slid forward so as make an engagement of the projection 7*b* of the switching lever 7 with the recess 1*c* of the housing 1, as shown in FIG. 3. Such an operation of the switching lever 7 causes the trigger-limitation device 6, which is connected to the switching lever 7 by means of the flexible power transmission member 11, to slide down in the guide section 8 against the function of the compression coil spring 12 so as to retract from the receiving hole 4*a* for the trigger 3 between the switch box 3 and the trigger 4.

In such a state, when the trigger 4 is pulled as shown in FIG. 4, the motor 15 operates to rotate the output shaft 2. When the trigger 4 is pulled further, the torque increases in proportion to the stroke of the trigger 4, as shown in FIG. 12. When the output torque reaches the maximum value, i.e., the torque "L" in the low torque range "P" and then the trigger 4 is continuously pulled, the trigger 4 passes through the constant torque zone "R" and then enter the high torque range "Q" so that the switch "c" turns "ON". As a result, the output shaft 2 can provide the high torque "H" (the maximum torque) at the stroke. Then, the trigger 4 comes into contact with the switch box 3 to stop. When the trigger 4 is kept coming into contact with the switch box 3, the output shaft 2 continuously provide the high torque "H" (the maximum torque). It is therefore possible to insert a screw into a hard material.

The present invention is not limited only to the above-described embodiment. In the embodiment of the present invention, the switching device is described as a plate having substantially the constant thickness. The switching device may be provided with a stepped portion, which enables the power tool to be operated in various strokes to provide some kinds of variation in output torque.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2004-32215 filed on Feb. 9, 2004 including the specification, claims, drawings and summary is incorporated herein by reference in its entirety.

What is claimed is:

1. An electric power tool comprising:

a housing;

an electric power unit received in the housing, said electric power unit having an output shaft;

a trigger slidably mounted on the housing, said trigger controlling operation of the electric power unit;

a trigger-limitation device mounted on the housing so as to be movable between a limited position where the trigger limitation device projects into a receiving hole for the trigger and an unlimited position where the trigger limitation device retracts from the receiving hole, said trigger-limitation device coming into contact with the trigger to limit a stroke of the trigger, when being kept in the limited position, and not coming into contact with the trigger to impose no limitation to the stroke of the trigger, when being kept in the unlimited position; and a switching device provided on the housing said switching device operating the trigger-limitation device to move between the limited position and the unlimited position.

2. The electric power tool as claimed in claim 1, further comprising:

a flexible power transmission member through which the trigger-limitation device and the switching device are connected; and wherein:

said housing is composed of a pair of half portions having abutting edges, which are to be brought into contact with each other, said abutting edges defining a guide passage in which said flexible power transmission member is to be received.

3. The electric power tool as claimed in claim 2, wherein:

said flexible power transmission member is formed of a substantially non-extensible material.

4. The electric power tool as claimed in claim 3, wherein:

said flexible power transmission member comprises a wire.

5. The electric power tool as claimed in claim 1, wherein:

said trigger-limitation device that is kept in the limited position enables the trigger to be slid within a low torque range in the stroke thereof, said low torque range being provided at an upper section thereof with a constant torque zone.

6. The electric power tool as claimed in claim 1, wherein:

said switching device comprises a lever.

7. The electric power tool as claimed in claim 1, wherein:

said switching device is kept away from the trigger so as to prevent an operator's finger for pulling the trigger from coming into contact with the switching device.

* * * * *